US006016127A

United States Patent [19]

Casciola et al.

[11] Patent Number: 6,016,127

[45] **Date of Patent: *Jan. 18, 2000**

[54] TRAVELING WAVE ANTENNA

[75] Inventors: Dean Casciola, Standish; Michael J. Figoli, Durham, both of Me.

[73] Assignee: Howell Laboratories, Inc., Bridgton, Me.

[ * ] Notice: This patent issued on a continued prosecution application filed under 37 CFR 1.53(d), and is subject to the twenty year patent term provisions of 35 U.S.C. 154(a)(2).

[21] Appl. No.: 08/669,749

[22] Filed: Jun. 26, 1996

[51] Int. Cl.[7] ..... H01Q 11/02

[52] U.S. Cl. ..... 343/731; 343/700 MS; 343/806

[58] Field of Search ..... 343/700 MS, 731, 343/806, 808, 809, 828, 829, 830, 846, 848

[56] References Cited

U.S. PATENT DOCUMENTS

| | | | |
|---|---|---|---|
| 3,302,207 | 1/1967 | Hoffman | 343/731 |
| 3,995,277 | 11/1976 | Olyphant, Jr. | 343/846 |
| 4,021,810 | 5/1977 | Urpo et al. | 343/846 |
| 4,286,271 | 8/1981 | Barbano et al. | 343/846 |
| 4,459,593 | 7/1984 | Hall et al. | 343/700 MS |
| 4,475,107 | 10/1984 | Makimoto et al. | 343/846 |
| 5,006,858 | 4/1991 | Shirosaka | 343/731 |
| 5,151,707 | 9/1992 | Kumpfbeck et al. | 343/829 |
| 5,367,307 | 11/1994 | Dupuis et al. | 343/700 MS |
| 5,457,470 | 10/1995 | Hai et al. | 343/830 |
| 5,585,807 | 12/1996 | Takei | 343/700 MS |
| 5,646,633 | 7/1997 | Dahlberg | 343/700 MS |

OTHER PUBLICATIONS

"A Circular Polarized Traveling–Wave Chain Antenna", Henriksson et al, Proceedings of the 9th European Microwave Conference, England Sep. 17–20, 1979

*Primary Examiner*—Don Wong
*Assistant Examiner*—Tan Ho
*Attorney, Agent, or Firm*—Samuels, Gauthier & Stevens

[57] ABSTRACT

A flat strip-like radiator is angled along the width of the strip to form radiating arms of predetermined length and angles to radiate a design radiation patter. The flat strip is secured to a ground plane such that the flat strip is perpendicular to the ground plane.

7 Claims, 2 Drawing Sheets

TRAVELING WAVE ANTENNA

BACKGROUND AND BRIEF SUMMARY OF THE INVENTION

The personal communications wireless network infrastructure requires antennas at each end of the link whether they are outdoors or indoors. These antennas are either passive or active in nature, and are designed to meet different cell coverage needs. These antennas will either be operating at 1850 to 1990 MHz in the United States with other frequency ranges being utilized overseas.

Presently known in the art are antennas which are directed to the passive market for outdoor wireless personal communication, operating in the 1850 to 1990 MHz range. Typically, these antennas are based on a low-profile flat panel design to cover the 30, 65, 85, 90 and 105 beamwidth requirements. The antennas are vertically polarized dipoles on an etched, high performance circuit board(s) on rigid aluminum channel-like back panels. The circuit board(s) are a significant factor in the total cost of the system.

The antennas of the present invention embody a single, simply configured, flat strip radiator spaced apart and electrically isolated from a planar ground plane. Variation in radiation patterns can be effected by simply forming different angles in the strip radiators.

Broadly the invention comprises an antenna having a planar ground plane and a flat strip-like radiator shaped to radiate different beamwidths and the method of making the antenna. The strip is secured to the ground plane such that the strips lie in a plane which is substantially parallel to the ground plane.

DESCRIPTION OF THE PREFERRED EMBODIMENT(S)

Figure 1:
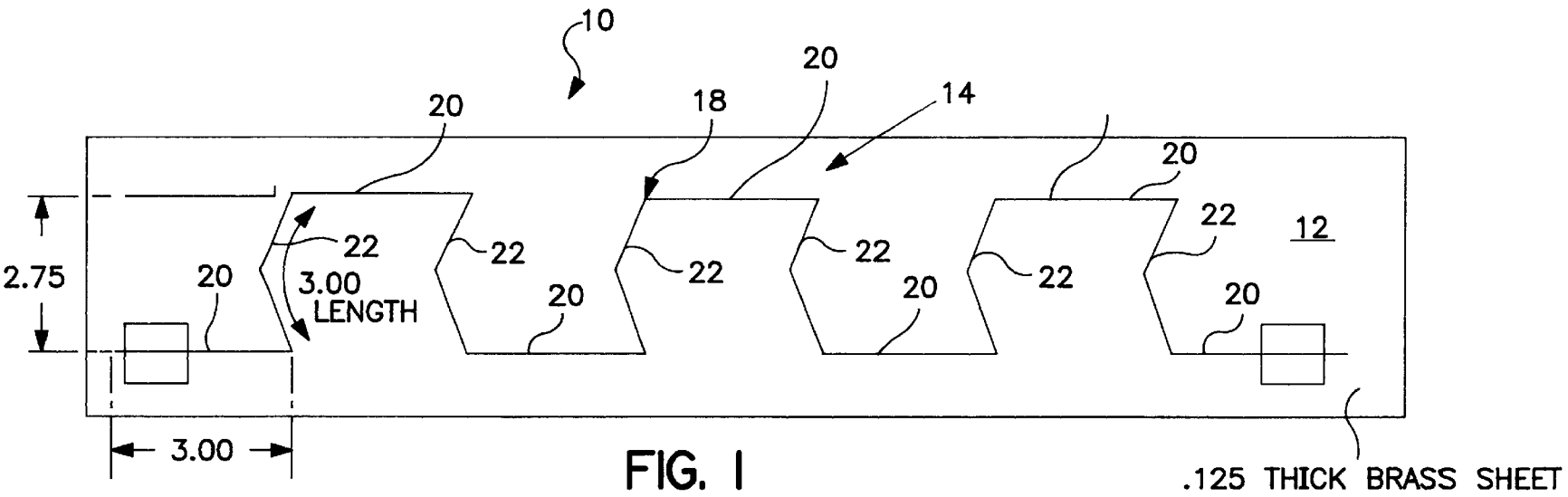
FIG. 1 is a plan view of a 65° bandwidth antenna embodying the invention.
Figure 2:
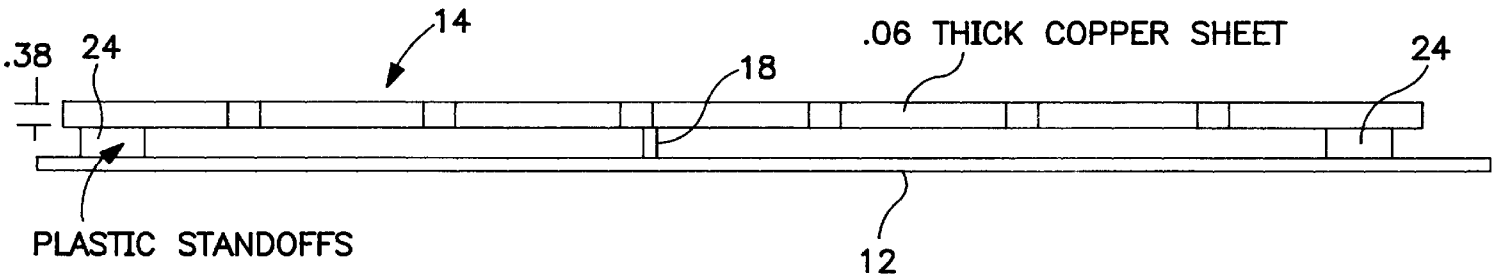
FIG. 2 is a side view of the antenna of FIG. 1.

Referring to FIG. 1, an antenna is shown generally at 10 and comprises a planar ground plane 12, a copper radiator 14 secured to the ground plane by plastic insulators 24. The radiator 14 is a flat strip ⅜ inch wide and 1/16 inch thick. The radiator shown is formed by bending the strip with simple tools. Power is introduced to the radiator 14 via a feed point 18. The radiator arms 20 are $\lambda/2$ and three inches in length. They are joined at 90° angles to V-like arms 22 which are $\lambda/2$ and 2.75 inches from end to end (original non V-length 3.00 inches). The radiator is spaced apart ½ inch from the ground plane (0.125 inches thick brass sheet) by Teflon® insulators 24. The specific feed lines, connectors, radome etc. associated with the antenna need not be described in detail these considerations being within the skill of the art. Based on the foregoing specifications, a 65° radiation pattern (beamwidth) will be provided at 1920 MHz.

As can readily be observed with the radiator of the invention, the length and angles of the arms can easily be formed, with a single bending tool and/or a vice and pliers. Variations in patterns (beamwidths) are achieved by forming different angles to change the spacing of the arms.

Figure 3:
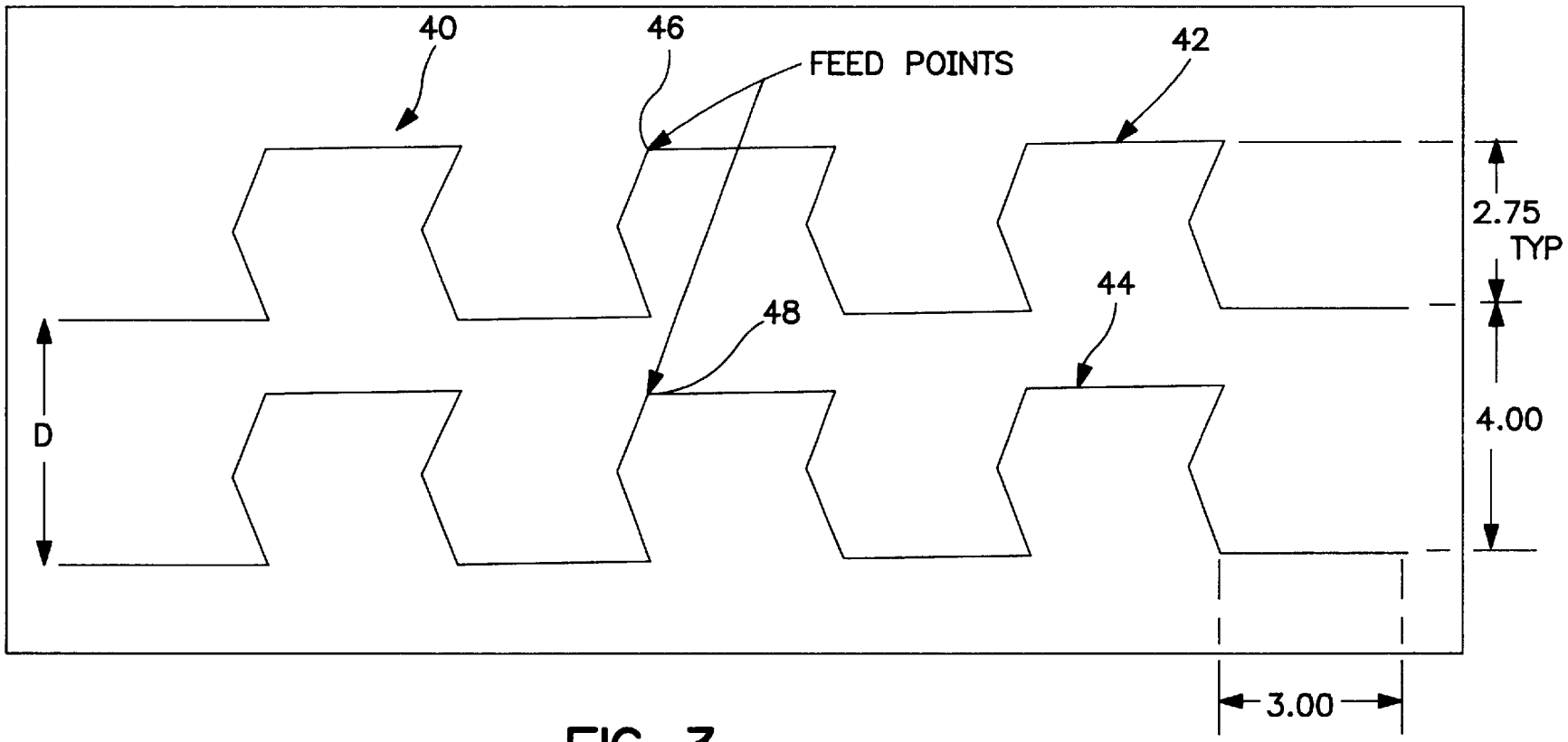
FIG. 3 is a plan view of a 30° beamwidth antenna embodying the invention.

Referring to FIG. 3, a 30° bandwidth antenna is shown at 40 having radiators 42 an 44 with their associated feed points 46 an 48 respectively. The radiators 42 and 44 are identical to the radiator 14 of FIG. 1. The distance D is 4.0 inches. This antenna operates at a frequency of 1920 MHz.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. A traveling wire antenna which comprises:

a substantially planar ground plane;

at least one insulator;

a flat strip-like radiator having a width and a length spaced above the ground plane, the plane in which the flat strip-like radiator lies being substantially parallel to the ground plane, the flat strip-like radiator being electrically isolated from the ground plane and supported by the insulator, the width of the flat-strip like radiator being substantially perpendicular to the ground plane, the radiator comprising a plurality of arms sequentially joined at their ends to define an angular relationship between adjacent arms, the length of the arms and the angles at which the arms are joined to one another, together provide a desired radiation pattern; and means for feeding power to the radiator.

2. The antenna of claim 1 wherein the radiator is configured to provide a 65° radiation pattern.

3. The antenna of claim 2 which comprises at least one radiator.

4. The antenna of claim 1 wherein the radiator is configured to provide a 30° radiation pattern.

5. The antenna of claim 4 which comprises at least two radiators.

6. A method of making a traveling wire antenna which comprises:

bending a flat strip-like material having a length and a width at predetermined lengths and angles;

securing the flat strip-like material onto a least one insulator and spaced above a ground plane, the flat strip-like material being supported by the insulator and substantially parallel to the ground plane and the width of the flat strip-like material being substantially perpendicular to the ground plane whereby when power is fed to the radiator the desired radiation pattern will be provided.

7. The method of claim 6 which comprises:

maintaining the radiators in spaced apart relationship from the ground plane by insulators.

* * * * *